US012305378B1

(12) United States Patent
Kazi

(10) Patent No.: US 12,305,378 B1
(45) Date of Patent: May 20, 2025

(54) WATER SOLUBLE TOOL FOR CLEARING BLOCKAGE IN A TOILET

(71) Applicant: Tauseef Kazi, San Diego, CA (US)

(72) Inventor: Tauseef Kazi, San Diego, CA (US)

( * ) Notice: Subject to any disclaimer, the term of this patent is extended or adjusted under 35 U.S.C. 154(b) by 0 days.

(21) Appl. No.: 18/668,473

(22) Filed: May 20, 2024

Related U.S. Application Data

(60) Provisional application No. 63/467,448, filed on May 18, 2023.

(51) Int. Cl.
*E03C 1/02* (2006.01)
*E03C 1/302* (2006.01)

(52) U.S. Cl.
CPC ..... *E03C 1/302* (2013.01)

(58) Field of Classification Search
CPC ..... E03C 1/302; E03C 1/30
USPC ..... 4/255.01
See application file for complete search history.

(56) References Cited

U.S. PATENT DOCUMENTS

| | | | | |
|---|---|---|---|---|
| 5,223,096 | A * | 6/1993 | Phan | D21H 21/20 162/168.3 |
| 9,015,890 | B1 | 4/2015 | Owens | |
| 9,068,330 | B2 | 6/2015 | Schultz | |
| 9,226,628 | B2 | 1/2016 | Morrison, Jr. | |
| 2010/0252071 | A1 | 10/2010 | Bounds | |
| 2012/0204334 | A1 | 8/2012 | Floto et al. | |
| 2014/0123377 | A1* | 5/2014 | Torres | E03C 1/302 4/255.01 |
| 2017/0298607 | A1* | 10/2017 | Cooper | E03C 1/302 |

* cited by examiner

*Primary Examiner* — Lauren A Crane
(74) *Attorney, Agent, or Firm* — Bold IP PLLC; Binita Singh

(57) ABSTRACT

A tool is described for a single use to break or push a clog in a toilet and that can then be disposed of into the toilet. The tool is made as a strong and flexible tool that can dissolve in water and is made from material that is environmentally safe. The tool provides a hygienic means to unclog a toilet. The tool is manufactured from a mixture comprising one or more water-soluble solids that are shredded and compacted into an elongate shape using a bonding material.

24 Claims, 6 Drawing Sheets

WATER SOLUBLE TOOL FOR CLEARING BLOCKAGE IN A TOILET

CROSS-REFERENCE TO RELATED APPLICATIONS

This application is a non-provisional application which claims priority to U.S. Provisional Patent Application No. 63/467,448 filed on May 18, 2023, which is incorporated by reference in its entirety.

TECHNICAL FIELD

The present invention relates to unclogging toilet drains, in particular to a dissolvable tool to dislodge an impediment in a clogged toilet drain.

BACKGROUND

Toilets are a necessity to have in a home. At some point a person will encounter a clogged toilet in their home. This is a situation where a toilet will not flush well, that is basically where flushed water will not drain out of the toilet bowl to clean away the waste. In such a case, the water level may remain high in the toilet bowl, or the water drains unusually slow. Toilets can develop drain clogs for several reasons, usually involving partial or complete obstruction in one of the various drain systems of the toilet. Most often the obstruction may be in the toilet trap, or the branch drain line, and a remedy for which is to plunge the toilet bowl using a common household tool such as a non-disposable and reusable plunger or auger.

However, there are disadvantages to using such tools. One disadvantage is that the plunger or auger, used to dislodge an obstruction, becomes soiled and germ laden from being in the toilet. Another disadvantage is that the plunger will need to be removed from the toilet, and thus potentially depositing germs elsewhere. Yet another disadvantage is that the soiled and germ laden non-disposable plunger after use, needs to be cleaned and stored for reuse, and once again creating the potential to soil and spread germ to other surfaces. And yet another disadvantage with using a plunger is that the plunger creates a vacuum to dislodge the obstruction, and while pushing and pulling to create the vacuum, the soiled water in the toilet may possibly splash outside of the toilet, once again contaminating other surfaces.

Some proposed solutions include disposable devices; however, these devices use a grabbing implement which is intended to be reused. However, these grabbing implements can become soiled in the process, or create additional waste that is not environmentally friendly.

Accordingly, there is still an unsolved need for a disposable tool that addresses these problems discussed above and may address other existing issues.

SUMMARY

The disclosed tool is unique when compared with other known tools and solutions because it provides a structurally different tool offering a flexible, strong, dissolvable, and completely flushable tool for dislodging clogs in toilet drainpipes. The disclosed tool also includes features that make it environmentally safe to be completely disposed into a toilet drain.

In one or more embodiments a tool to dislodge a clog in a toilet, or another drain, is described herein. The tool is configured as a flexible but strong tube having a length and a width to fit into a toilet drain. The tool may have a length which allows one end of the tube to be held in a user's hand, which will remain outside of the toilet bowl for hygienic purposes, and the other end of the tube is disposed into the toilet trap, or the toilet drain line. The tool may be comprised of single or multiple dissolvable materials, or just two layers, an inner layer or core and an outer layer. The two layers have differing rates of disintegration when exposed to a liquid, such as water in a toilet bowl, wherein the outer layer has a slower rate of disintegration, and the inner layer has a faster rate of disintegration. Thus, the entire tool is dissolvable and flushable.

In another non-limiting embodiment, a tool to dislodge a clog in a toilet or another drain is described. The tool is configured as a flexible and strong tube having a length and a width, wherein one end of the tube is configured with a dislodging head. The length of the tube allows one end of the tube to be held in a user's hand, which will remain outside of the toilet bowl for hygienic purposes, and the other end of the tube with the dislodging head is disposed into the toilet trap, or the toilet drain line. The tool may be comprised of single or multiple dissolvable materials, or just two layers, an inner layer or core and an outer layer. The two layers have differing rates of disintegration when exposed to a liquid, such as water in a toilet bowl, wherein the outer layer has a slower rate of disintegration, and the inner layer has a faster rate of disintegration. Thus, the entire tool is dissolvable and flushable.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

FIG. 5 is pictorial illustration of an environmental view of the tool from FIG. 6 being used in a toilet in accordance with an illustrative embodiment.

DETAILED DESCRIPTION

Figure 1:
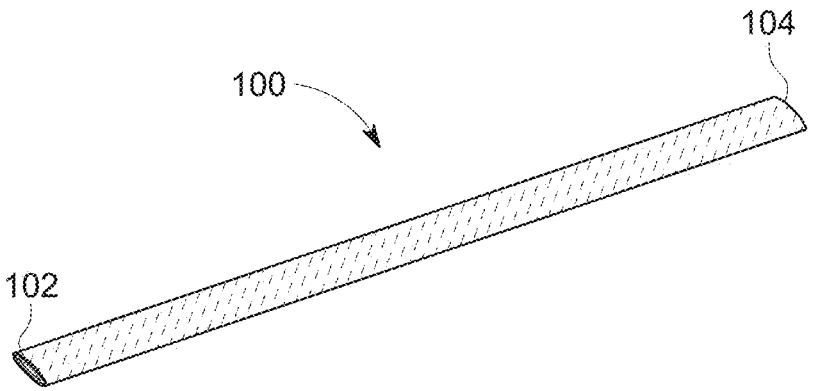
FIG. 1 is a pictorial illustration of a tool that can be used to unclog a toilet drain in accordance with an illustrative embodiment.

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100 and includes both 25 and 100.

Referring now to the drawings and the following written description of the present invention, it will be readily understood by those persons skilled in the art that the present invention is susceptible to broad utility and application. Many embodiments and adaptations of the present invention other than those described herein, as well as many variations, modifications, and equivalent arrangements will be apparent from or reasonably suggested by the present invention and the detailed description thereof without departing from the substance or scope of the present invention. This disclosure is only illustrative and exemplary of the present invention and is made merely for purposes of providing a full and enabling disclosure of the invention.

The present disclosure is generally directed to one or more non-limiting embodiments of a water-soluble toilet unclogging tool, which will be referred to as a tool herein. The tool, as the name suggests, provides an easy and hygienic way of disposing a tool that was used in a toilet to displace/break a clog. The tool is designed to provide a flexible, strong, and dissolvable single use tool that is disposable in the toilet after use. The tool can come in one or more layers such that each layer dissolves at a different rate. Further details are provided below with reference to the figures.

Figure 2:
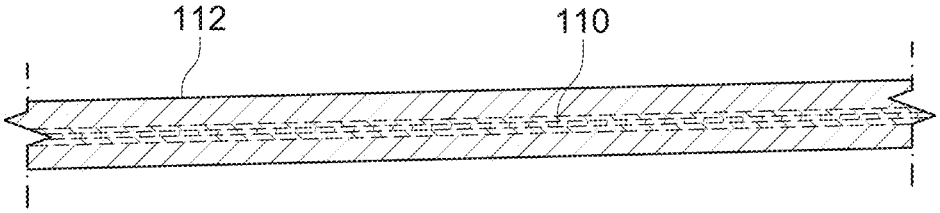
FIG. 2 is a cross sectional view of the tool in accordance with an illustrative embodiment.
Figure 3:
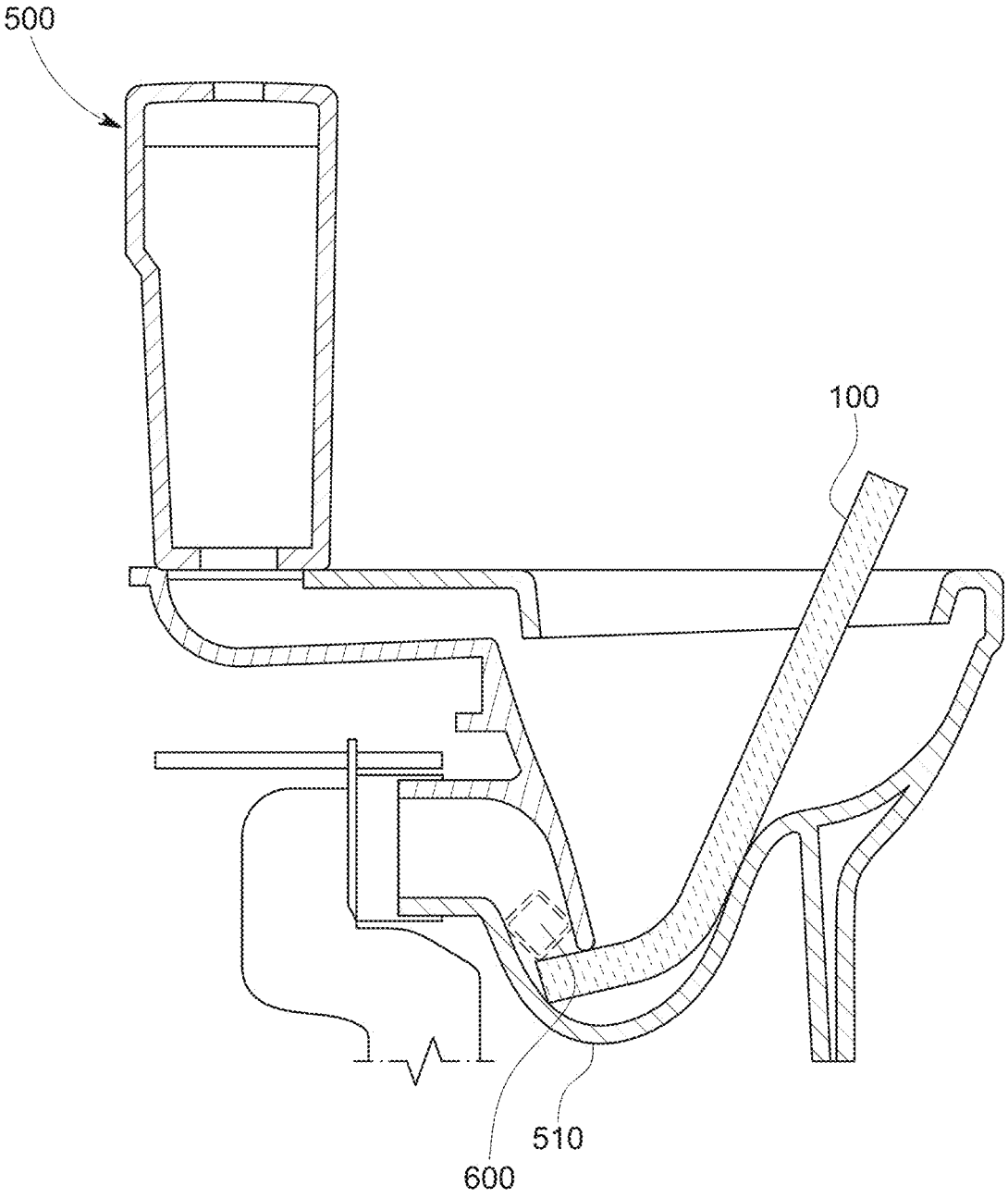
FIG. 3 is a pictorial illustration of an environmental view of the tool being used in a toilet in accordance with an illustrative embodiment.

FIGS. 1-3 are illustrations of a non-limiting embodiment of a tool 100, which is an example of a tool that can be used to break or dislodge a clog in a toilet and then be disposed of directly in the toilet to dissolve or otherwise be flushed with the clog. The tool 100 described in this embodiment may be fashioned from material that is capable of disintegrating in water and is safe for the environment (environmentally friendly) to be disposed of in such a manner. Referring to FIGS. 1-2, the pictorial illustrations depict an example configuration of the tool 100 and a cross-sectional view along a length of the tool 100, respectively.

FIG. 1 is an illustrative perspective view of an example configuration of the tool 100 that can be used to dislodge/break a clog 600 (See, FIG. 3) in a toilet. This illustration is shown of the tool 100 having an elongate shape which can have a variety of configurations including varied length, cross-sectional width, and cross-sectional shape to name a few. In FIG. 1, the tool 100 is shown to have a round cross-sectional shape. Other cross-sectional shapes may be used including and not limited to oval, rectangular, triangular, and polygonal. The tool 100 is also shown to comprise two ends, a first end 102 and a second end 104, which are relatively similar in shape and size. In one non-limiting embodiment, either end 102, 104 can be used as a grip to facilitate a user to grab the tool 100. And, in conjunction with gripping the tool 100, either end 102, 104 may be inserted into the toilet to service the problem. Alternative embodiments will be discussed later.

The tool 100 will have a length that provides a distance to a user's hand when the tool 100 is gripped and inserted into the toilet to service the problem. For example, a user grips the tool 100 at the first end 102 and inserts the second end 104 into the toilet trap or the toilet drain. The length of the tool 100 provides enough distance between the first end 102, which is being gripped, and the second end 104 which is inserted into the toilet to prevent the user's hands from getting contaminated with the toilet bowl water. To prevent this kind of contamination and allow the tool 100 to function properly, the tool 100 may have a length between 1.5 feet to 3 feet. It is to be understood, that a user can grip either end 102, 104 of the tool 100, and the above is an example description to illustrate use of the tool 100.

The tool 100 may be configured of one tubular piece and comprise of a singular mold of a mixture of biodegradable and water-soluble materials. The material used to make the tool 100 includes water-soluble solids that are shredded and mixed with a bonding material. The water-soluble solids may include water soluble paper, virgin paper product (i.e., chipped wood), recycled pulp, bamboo pulp, or other biodegradable paper product that can biodegrade in water.

In one or more embodiments, the bonding material may include a bonding adhesive which may be used to bond the shredded water-soluble solids together. The bonding adhesive may include water-based resin or adhesive that is water soluble, natural, and environmentally friendly. Some examples of the bonding adhesive include and are not limited to: Vegetable based Glue/Starch (Dextrin); Corn and Rice Starch-based bioplastic; Polyvinyl acetate (PVA) adhesives; and Natural Rubber and Polychloride Adhesives.

Alternative bonding materials may also be used wherein the mixture of shredded water-soluble solids may be mixed with materials that are used to make soap. The material used to make soap generally include a mixture of fat (or oil) and an alkali. The alkali is generally sodium hydroxide. Thus, the shredded paper can be mixed with the oil and alkali and molded into the elongate shape to make the tool 100.

FIG. 2 illustrates the cross-sectional view of an alternative configuration of tool 100. In this non-limiting configuration, the tool 100 is comprised of an inner layer 110 and an outer layer 112. The inner and outer layers 110, 112 are configured with the above listed materials. However, the inner layer 110 is fashioned with material that disintegrates or breakdown at a faster rate than the material that is used to fashion the material on the outer layer 112. The expectation is that the outer layer 112 will be exposed to the water first and for a longer time than the inner layer 110. The tool 100 will need to maintain the strength and flexibility for a period of time to allow the tool 100 to push or break the clog in the toilet, which can be maintained with a slower dissolving outer layer 112. The inner core 110 allows the tool to have a certain width to help with the force, flexibility to navigate into the curves of the drain, and strength needed to break or push the clog in the toilet, and yet be able to degrade quickly in water once exposed to water. The inner core 110 will be exposed to water once the outer core 112 has degraded. In this embodiment, the inner core 110 would be mixed and molded with the appropriate material and a mixture of the appropriately slower degrading material would be applied to the inner core 110.

In yet another configuration, the tool 100 may be manufactured with a slower dissolving mixture of water-soluble solids and bonding material concentrated at either the first end 102 or the second end 104 of the tool and the faster dissolving material concentrated at the opposite end. In such an embodiment, the concept is that the user would grip the tool 100 at the faster dissolving end and work the slower dissolving end into the toilet and that slower dissolving end would be exposed to water and would also need the strength and flexibility to break the clog 600 in the toilet.

In another configuration, the tool 100 could be in the form of a snake wire rolled onto a reel. The snake would be pushed into the pipe to unclog it and the portion inside the pipe and wet from the toilet bowl contents will be cut and left inside the pipe to get dissolved into the drainpipe.

FIG. 3 illustrates the tool from FIGS. 1 and 2 in the environment that it is used in. The tool 100 is showed being used in a toilet 500 to break or push an obstruction 600 in the toilet drain 510. The tool 100 has the flexibility to navigate the curves of the drain and the strength to break the clog.

Figure 4:
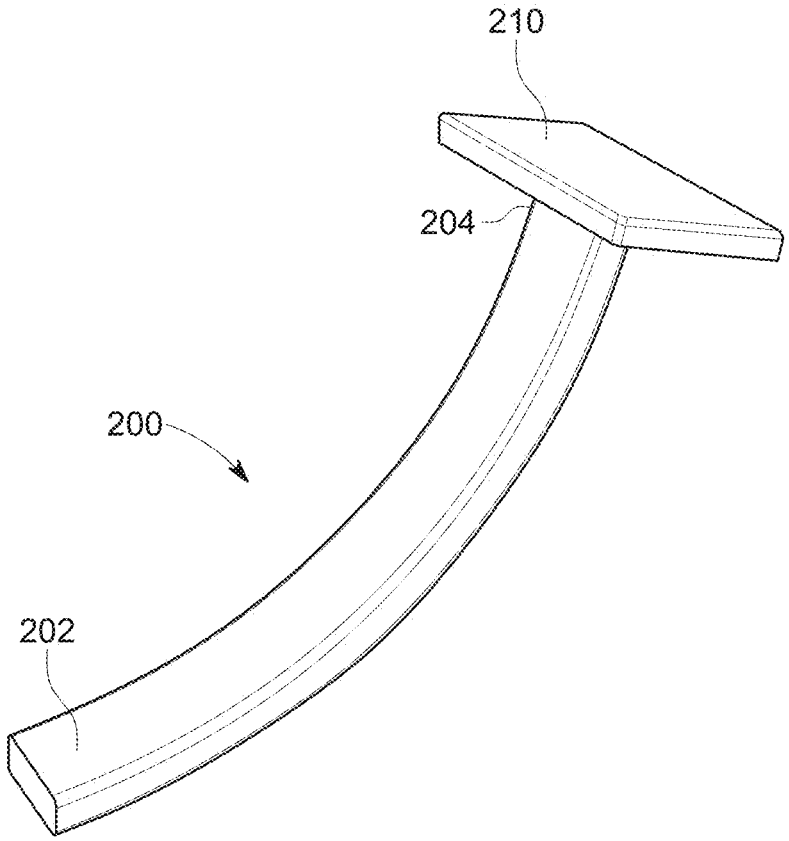
FIG. 4 is a pictorial illustration of an alternate embodiment of a tool that can be used to unclog a toilet drain in accordance with an illustrative embodiment.
Figure 5:
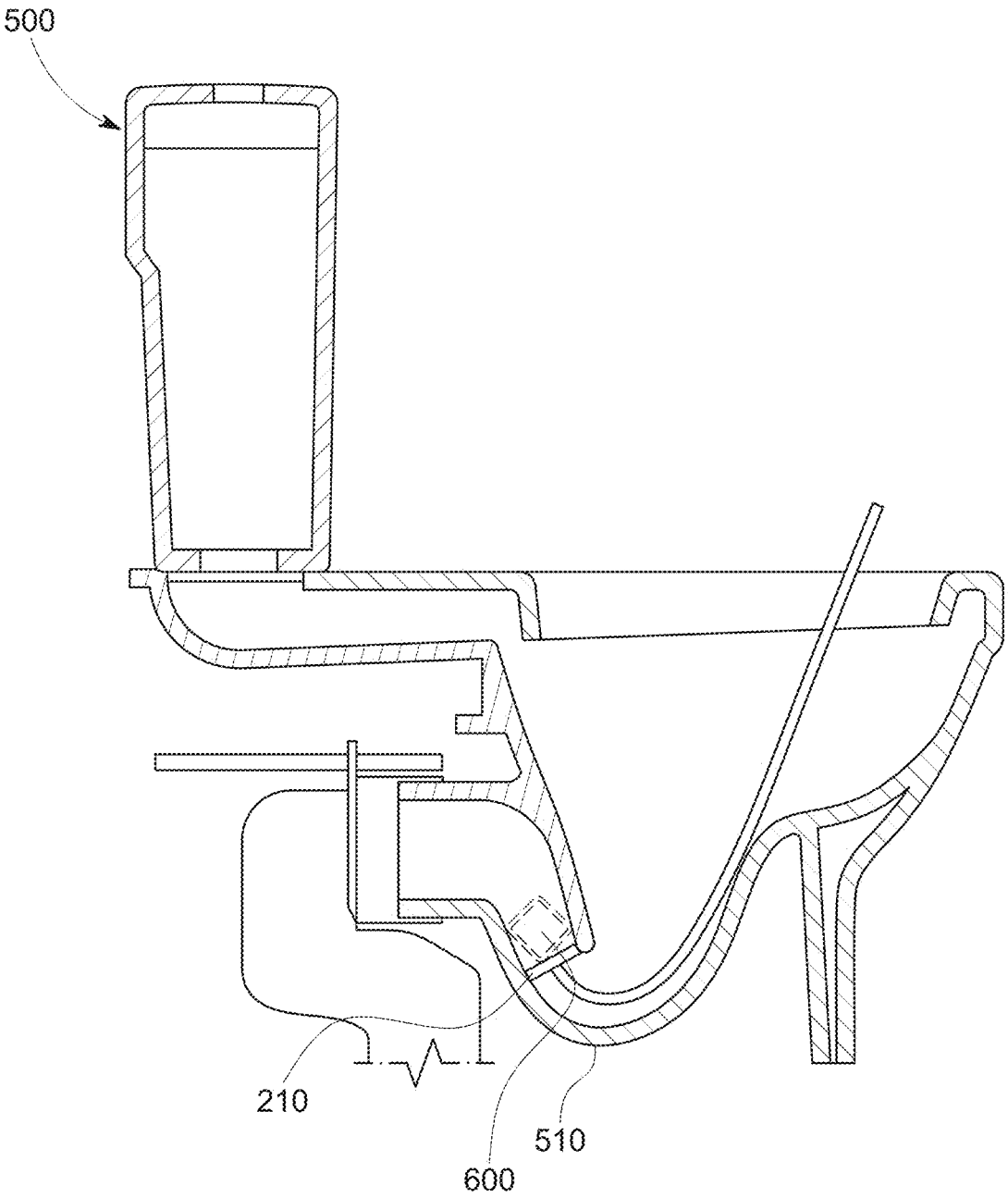
FIG. 5 is pictorial illustration of an environmental view of the tool from FIG. 4 being used in a toilet in accordance with an illustrative embodiment.

FIGS. 4 and 5 illustrate an alternative embodiment of a tool 200 that can be used to dislodge/break a clog 600 in a toilet 500. FIG. 4 is an illustrative perspective view of an example configuration of the tool 200 comprising a dislodging head 210 that can be used to dislodge/break a clog in a toilet. This illustration is shown of the tool 200 having an elongate shape which can have a variety of configurations including varied length, cross-sectional width, and cross-sectional shape to name a few. In FIG. 4, the tool 200 is shown to have a rectangular cross-sectional shape. Other cross-sectional shapes may be used including and not limited to oval, circular, triangular, and polygonal. The tool 200 is also shown to comprise two ends, a first end 202 and a second end 204, which are relatively similar in shape and size. In this non-limiting embodiment, the second end 204 is configured with the dislodging head 210. The elongate shape of the tool 200 is curved proximal to the second end 204. Thus, the first end 202 can be used as a grip to facilitate a user to grab the tool 200 and inserting the dislodging head 210 into the toilet to service the problem. With the curved body, the tool 200 is able to access the drainpipe of the toilet with ease, rather than having to bend the tool 200.

As seen in the illustrations, the dislodging head 210 has a body that is sized and shaped to be inserted into a drain to push against the clog to break and/or dislodge the clog. In the example shown in FIGS. 4 and 5, the dislodging head 210 has a flattened shape which is wider than the cross-sectional width of the second end where the dislodging head 210 is configured. The flattened shape is shown to have a polygonal shape; however, it is to be understood that the flattened shape can include any shape as long as the dislodging head 210 is provided to press against a clog. It is also to be understood that the dislodging head can have a rounded shape and not be limited to a flattened shape. Again, the purpose served by the dislodging head 210 is to press against a clog in the toilet drain or any other drain. The clog is pushed against and forced to move through the drain and/or break up from the pressure of the dislodging head 210.

Also, similar to the above embodiment, the tool 200 may be configured of a singular mold of a mixture of biodegradable and water-soluble materials. Alternatively, the tools 200 may be comprised of two layers. In yet another embodiment, the tool 200 may include the dislodging head 210 being fashioned from a slower disintegrating material than the elongate shape.

Figure 6:
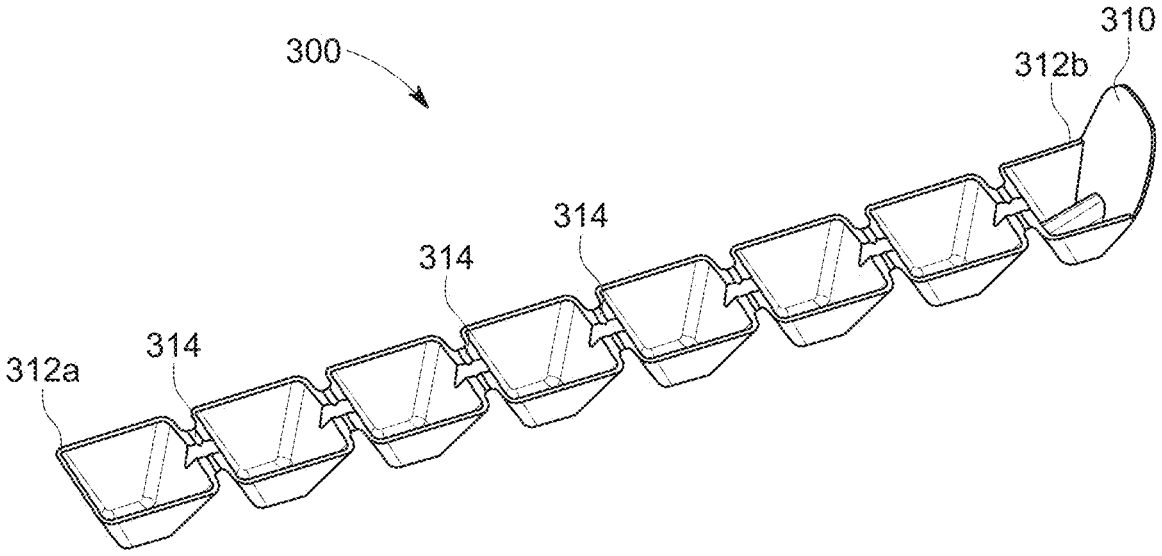
FIG. 6 is a pictorial illustration of an alternate embodiment of a tool that can be used to unclog a toilet drain in accordance with an illustrative embodiment.
Figure 7:
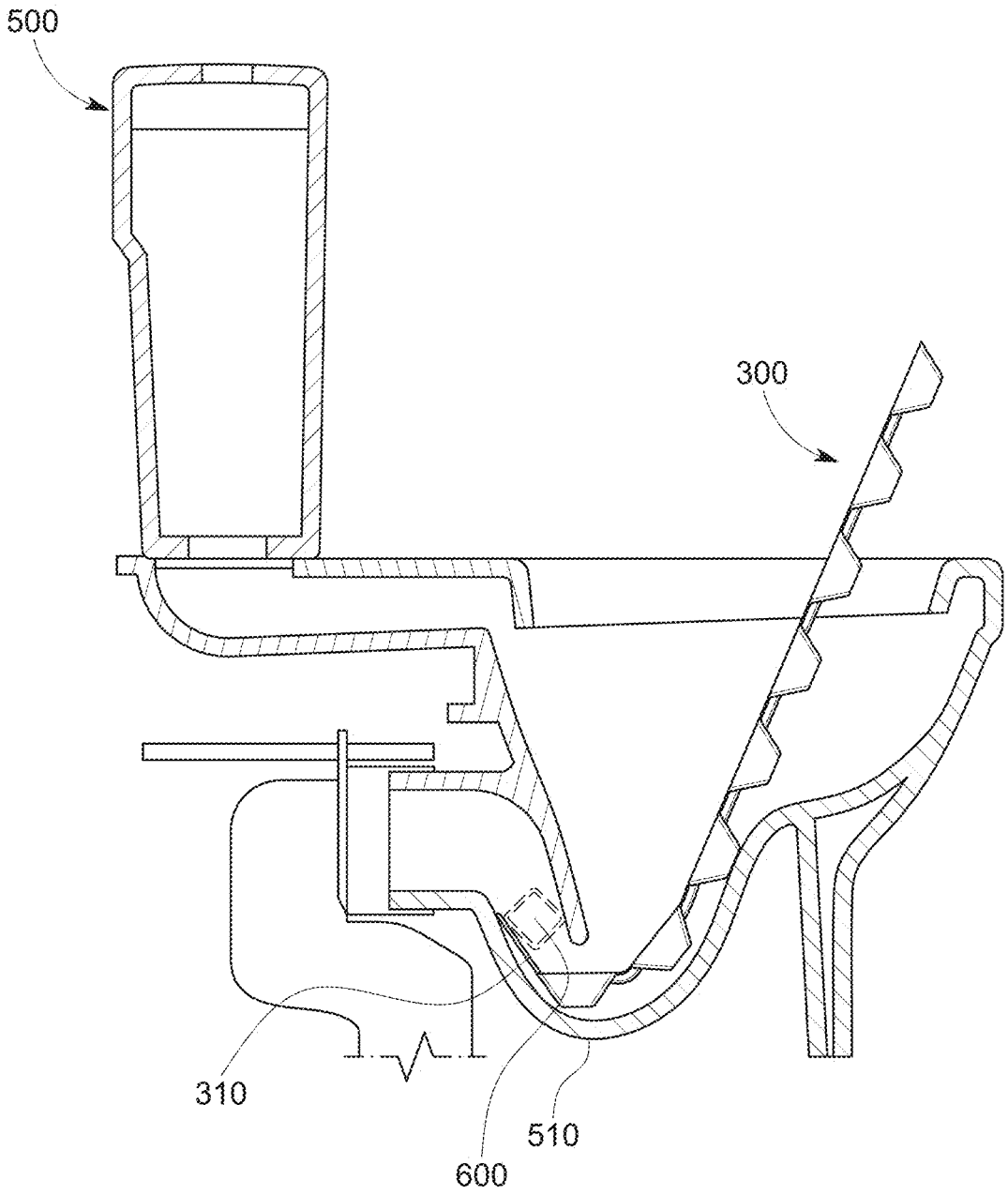

FIGS. 6 and 7 illustrate yet another embodiment of a tool 300 that can be used to dislodge/break a clog in a toilet 500. FIG. 6 is an illustrative perspective view of an example configuration of the tool 300 comprising an elongate body 312 having a shape configured of multiple cup shaped bodies adjoined together and a dislodging head 310 that can be used to dislodge/break a clog in a toilet. This illustration shows the elongate body 312 with the multiple cup shaped bodies arranged in a line wherein the cup shaped bodies are equally sized and shaped. The cup shaped bodies are configured such that the elongate body 312 can be rolled up so that the cup shaped bodies can be nestled into each other during packaging and unrolled for use. Essentially, the elongate body is folded at each of the connection joints 314 between the multiple cup shaped bodies. As shown in the figures, the elongate body 312 has two ends with a first end 312*a* and a second end 312*b*. In this non-limiting embodiment, the cup on the second end 312*b* is configured with the dislodging head 310. Thus, the first end 312*a* can be used as a grip to facilitate a user to grab the tool 300 and insert the dislodging head 310 on the second end 312*b* into the toilet to service the problem.

Similar to the above embodiment of the tool 100, the embodiment of the tool 300 will have a length that provides a distance to a user's hand when the tool 300 is gripped and inserted into the toilet to service the problem. The length of the tool 300 provides enough distance between the first end 312*a*, which is being gripped, and the second end 312*b* with the dislodging head 310 which is inserted into the toilet 500 to prevent the user's hands from getting contaminated with the toilet bowl water.

As seen in the illustrations, the dislodging head 310 has a body that is sized and shaped to be inserted into a drain to push against the clog to break and/or dislodge the clog. In the example shown in FIGS. 6 and 7, the dislodging head 310 has a flattened shape which is longer than the cross-sectional length of the second end 312*b* with a cup shaped body where the dislodging head 310 is configured. The flattened shape is shown to have a polygonal shape; however, it is to be understood that the flattened shape can include any shape as long as the dislodging head 310 is provided to press against a clog. It is also to be understood that the dislodging head can have a rounded shape and not be limited to a flattened shape. Again, the purpose served by the dislodging head 310 is to press against a clog in the toilet drain or any other drain. The clog is pushed against and forced to move through the drain and/or break up from the pressure exerted through the dislodging head 210.

Accordingly, the present description provides for various embodiments for a tool that is for a single use to break or push a clog in a toilet and that can then be disposed of into the toilet. The tool is made as a strong and flexible tool that can dissolve in water and is made from material that is environmentally safe. The tool provides a hygienic means to unclog a toilet. Many uses and advantages are offered by the device as described above in one or more non-limiting embodiments in the present description.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A tool comprising:

a tubular shaped body, having a length and a width, wherein the tubular shaped body is configured of two layers, an outer layer and an inner layer having varying rates of disintegration in water, wherein the outer layer fully surrounds the inner layer along the length of the tubular shaped body where the outer layer is present, and wherein each of the two layers of the tubular shaped body is manufactured from a mixture comprising:

one or more water-soluble solids; and a bonding material;

wherein the length of the tubular shaped body is such that a first end of the tool can be held outside of a toilet and a second end can be placed inside of a drainpipe of the toilet; and wherein the tool is configured to dislodge a clog in the toilet, and wherein the tool is disposed in the toilet such that the tool dissolves and/or disintegrates in water in the toilet.

2. The tool of claim 1, wherein the inner layer is fashioned from a mixture that disintegrates in water at a faster rate than a rate of disintegration in water of a mixture used to fashion the outer layer.

3. The tool of claim 1, wherein the first end and the second end of the tubular shaped body disintegrate in water at varying rates, wherein the first end is configured with a mixture that disintegrates at a faster rate than a rate of disintegration of the second end.

4. The tool of claim 1, wherein the tubular shaped body is comprised of one tubular piece and comprises a single mold of the mixture.

5. The tool of claim 1, wherein the tubular shaped body is alternatively comprised of a single water soluble solid instead of the mixture comprising one or more water soluble solids and the bonding material.

6. The tool of claim 1, wherein the one or more water-soluble solids are chosen from a list including water soluble paper, virgin paper product, recycled pulp, bamboo pulp, or a composite.

7. The tool of claim 1, wherein the bonding material is chosen from a list including a water-based resin, an oil and alkali mixture, or an adhesive that is water soluble, natural, and/or environmentally friendly.

8. The tool of claim 1, wherein the tool is provided on a reel and a desired length is unrolled from the reel and cut for use.

9. A tool comprising:

a tubular shaped body, having a length and a width, wherein the tubular shaped body is configured of two layers, an outer layer and an inner layer having varying rates of disintegration in water, wherein the outer layer fully surrounds the inner layer along the length of the tubular shaped body where the outer layer is present, and wherein each of the two layers is manufactured from a mixture comprising:

one or more water-soluble solids; and a bonding material;

wherein the tubular shaped body has a first end and a second end, wherein the second end has a cross-sectional shape wider than a cross-sectional shape of the first end of the tubular body;

wherein the length of the tubular shaped body is such that a first end of the tool can be held outside of a toilet and a second end can be placed inside of a drainpipe of the toilet; and wherein the tool is configured to dislodge a clog in the toilet, and wherein the tool is disposed in the toilet such that the tool dissolves and/or disintegrates in water in the toilet.

10. The tool of claim 9, wherein the tubular shaped body proximal to the second end is curved inward toward the tubular shaped body.

11. The tool of claim 9, wherein the inner layer is fashioned from a mixture that disintegrates in water at a faster rate than a rate of disintegration of a mixture used to fashion the outer layer.

12. The tool of claim 9, wherein the first end of the tubular body is configured with a mixture that disintegrates at a faster rate than a rate of disintegration of a material used to fashion the second end of the tubular body including the dislodging head.

13. The tool of claim 9, wherein the tubular shaped body is comprised of one tubular piece and comprises a single mold of the mixture, wherein the dislodging head is configured of a mixture that disintegrates at a slower rate than the tubular shaped body.

14. The tool of claim 9, wherein the tubular shaped body is alternatively comprised of a single water soluble solid instead of the mixture comprising one or more water soluble solids and the bonding material.

15. The tool of claim 9, wherein the one or more water-soluble solids are chosen from a list including water soluble paper, virgin paper product, recycled pulp, bamboo pulp, or a composite.

16. The tool of claim 9, wherein the bonding material is chosen from a list including a water-based resin, an oil and alkali mixture, or an adhesive that is water soluble, natural, and/or environmentally friendly.

17. A tool comprising:

an elongate body, having a first end and a second end, wherein the second end has a cross-sectional shape wider than a cross-sectional shape of the first end of the elongate body, wherein the elongate body is configured of two layers, an outer layer and an inner layer having varying rates of disintegration in water, wherein the outer layer fully surrounds the inner layer along the length of the elongate body where the outer layer is present, and wherein each of the two layers is manufactured from a mixture comprising:

one or more water-soluble solids; and a bonding material;

wherein the length of the elongate body is such that a first end of the tool is held outside of a toilet and a second end of the tool is placed inside of a drainpipe of the toilet; and wherein the tool is configured to dislodge a clog in a toilet, and wherein the tool is disposed in the toilet such that the tool dissolves and/or disintegrates in water in the toilet.

18. The tool of claim 17, wherein the elongate body is configured with multiple cup shaped bodies, each connected by connection joints, and adjoined in a straight line.

19. The tool of claim 18, wherein the elongate body is packaged in a rolled state wherein the elongate body is folded at each of the connection joints between the multiple cup shaped bodies.

20. The tool of claim 17, wherein the elongate shaped body is comprised of one piece and comprises a single mold of the mixture.

21. The tool of claim 17, wherein the elongate shaped body is alternatively comprised of a single water soluble solid instead of the mixture comprising one or more water soluble solids and the bonding material.

22. The tool of claim 17, wherein the one or more water-soluble solids are chosen from a list including water soluble paper, virgin paper product, recycled pulp, bamboo pulp, or a composite.

23. The tool of claim 17, wherein the bonding material is chosen from a list including a water-based resin, an oil and alkali mixture, or an adhesive that is water soluble, natural, and/or environmentally friendly.

24. The tool of claim 17, wherein the first end of the elongate body is configured with a mixture that disintegrates at a faster rate than a rate of disintegration of a material used to fashion the second end of the elongate body.

* * * * *